US007077301B2

(12) United States Patent
Dudley

(10) Patent No.: US 7,077,301 B2
(45) Date of Patent: Jul. 18, 2006

(54) APPARATUS FOR ORGANIZING AND DISPLAYING CLOTHING

(76) Inventor: Dorothy B. Dudley, 6008 Sharon Hills Rd., Charlotte, NC (US) 28210

( * ) Notice: Subject to any disclaimer, the term of this patent is extended or adjusted under 35 U.S.C. 154(b) by 496 days.

(21) Appl. No.: 10/068,763

(22) Filed: Feb. 5, 2002

(65) Prior Publication Data

US 2003/0146250 A1 Aug. 7, 2003

(51) Int. Cl.
*A41H 5/00* (2006.01)

(52) U.S. Cl. ..... 223/120

(58) Field of Classification Search ..... 226/66; D20/31; 211/85.3, 16; 40/411; 434/395, 434/267; D21/621; D6/315, 316; 223/120; 446/72, 97, 98

See application file for complete search history.

(56) References Cited

U.S. PATENT DOCUMENTS

D164,853 S * 10/1951 Gross et al. ..... D6/412
3,974,593 A 8/1976 Walker, Jr. ..... 46/22
4,276,031 A 6/1981 Lueck ..... 434/260
4,545,514 A * 10/1985 Toy ..... 223/66
4,563,373 A 1/1986 Barnett ..... 428/16
4,637,798 A 1/1987 Maiden-Nesset ..... 434/191
4,739,911 A * 4/1988 Quinn ..... 223/85
4,792,071 A * 12/1988 Scarpa et al. ..... 223/68
4,798,317 A 1/1989 Lonczak ..... 223/66
D302,213 S * 7/1989 Motazedi ..... D6/316
5,282,749 A 2/1994 Ketch ..... 434/395
D354,654 S * 1/1995 Mallen ..... D6/552
5,377,849 A * 1/1995 Martin ..... 211/85.7
5,480,074 A * 1/1996 Duncan et al. ..... 223/66
6,601,326 B1 * 8/2003 Bublitz et al. ..... 40/418

* cited by examiner

*Primary Examiner*—Gary L. Welch
(74) *Attorney, Agent, or Firm*—Kennedy Covington Lobdell & Hickman, LLP

(57) ABSTRACT

An apparatus for organizing and displaying clothes having a three-dimensional, humanlike form supported by a base, the form having at least one projection from which to suspend clothing, hangers, accessories, or other suspendable articles. The form also has hands having a flat or concave palm upon which loose articles such as coins and jewelry can be placed. A tray may be removably attached to the hand. The apparatus may be adjustable, allowing the form to "grow" in conformity with the growth of a child.

29 Claims, 10 Drawing Sheets

APPARATUS FOR ORGANIZING AND DISPLAYING CLOTHING

FIELD OF INVENTION

The present invention relates to apparatus used to organize and display clothing, specifically an entire set of children's clothing, including underwear, outer garments (i.e., coats or sweaters), shoes, and accessories (i.e., belts, jewelry or pocket articles).

BACKGROUND OF INVENTION

Apparatus for displaying clothing has long been in use, particularly in the commercial retail clothing business. The use of some form or mannequin upon which sales personnel displayed the current fashions for sale has been a staple of the retail clothing stores for years. Other types of clothing displays have been used in the home, generally some sort of frame for adults to drape pants or hang a suit from. There have been some partial forms or mannequins that have a human shape which uses clothes hangers upon which to display clothing (U.S. Pat. No. 4,739,911). But generally the past inventions have been three-dimensional models that had to be dressed in clothing, or two-dimensional partially humanlike shapes that have been missing the lower portion of the body or certain appendages. Furthermore, none have been specifically aimed at giving children a form close to their size upon which they could assemble and display their own clothing.

There have also been inventions aimed at teaching children how to fold clothes (U.S. Pat. No. 5,282,749), how to manipulate the various fasteners on clothing (U.S. Pat. No. 4,276,031), and even to encourage children to return clothing to hangers (U.S. Pat. No. 4,563,373). Additionally, previous inventions have included dolls used to teach children counting, colors, textures and to develop and improve manual dexterity (U.S. Pat. Nos. 4,276,031 and 4,637,798); some of these dolls provided detailed methods for teaching children how to dress themselves. However, there have not been any known inventions that allow the child to assemble his or her own clothing on a model approximating their size, allowing for the advanced selection and organization of clothing, and employing the child's natural curiosity in helping the child learn, alone or with parental guidance, how to choose and organize the appropriate clothing well prior to the time the clothing is actually needed.

OBJECT AND SUMMARY OF THE INVENTION

The object of the present invention is to provide an apparatus that encourages children to pre-select a set of clothing, for example their school clothing for the following day, to lessen the delay and stress, on the child and the parents, of selecting the clothing, finding the selected clothing, locating and coordinating accessories and locating outer garments such as hats, gloves, and shoes. This objective is attained by providing the children with a model similar to their size upon which they can assemble and display the clothing, generally suspended from standard clothes hangers, outer garments, and shoes they selected earlier, thereby having a complete outfit readily available.

Another object of the present invention is to help children learn how to select articles of clothing and to encourage children to develop the habit of dressing themselves. This objective is attained by providing the child with a model upon which the child can assemble and display a complete clothing outfit.

The present invention is a three-dimensional form that is similar in size to a human child. The form has a head, a torso, two arms, two legs, two feet and rests upon a base that is sufficiently large to maintain the form in an upright position. At least one and preferably multiple projections are located in certain locations on the form upon which articles of clothing (i.e., a shirt, pants or skirt) can be suspended, either by itself or on a standard clothes hanger. The projections are of the size to allow a child to easily hang the clothing or hangers.

In the preferred embodiment, the torso is made of two separate parts as are the legs. One part of the torso is telescopingly received into the other part of the torso and one part of each leg is telescopingly received into the other part of each leg. In this manner, the torso and the legs are adjustable, allowing the form to increase in height or "grow" with the child.

One feature of the present invention is the capability of the head and neck to rotate about a vertical axis so that the position of the head relative to the torso can be changed by the child. Another feature of the present invention is that it is made of material upon which removable self-adhesive stickers may be applied, thus allowing the child to decorate and personalize the form. Likewise, the head may have ears attached.

In the preferred embodiment, the arms are constructed such that the hand can be selectively positioned, for example with the palm facing up or with the hand vertically aligned adjacent to the torso and with the palm facing toward the torso. The selective positioning allows the child to choose having a location for a child to store loose articles such as jewelry, hair clips, barrettes, coins, combs, and other pocket objects in the hand and clothing articles draped over the crook of the elbows, or to have the hands oriented downwardly, for example to put the form in a corner or small space. One feature of the present invention is the placement of a tray upon the upraised hand, the tray bottom molded to surround the edges of the hand so that the tray rests securely upon the hand, thereby providing a larger receptacle on which to place the loose articles discussed above.

A further feature of the present invention provides other projections from which to display accessories such as belts, neckties, and underwear.

A further feature of the present invention provides locations from which to drape an outer garment such as a light-weight coat or sweater, place shoes or other footwear, and place a hat or other headwear.

A further feature of the present invention provides circular loops affixed to the form at about the knees from which may hang socks, stockings or other hosiery.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
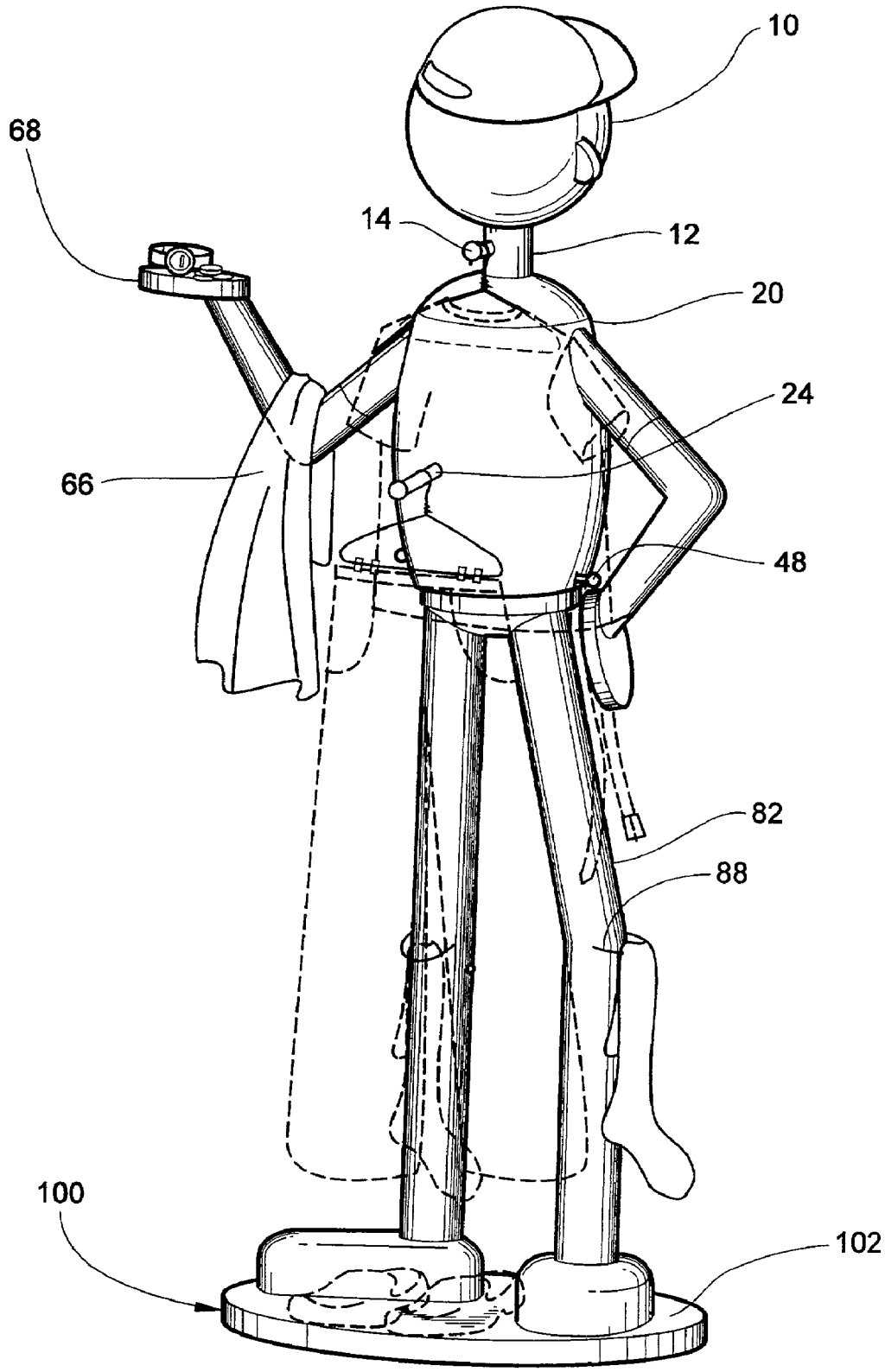
FIG. 1 is a front perspective view of an apparatus for organizing and displaying clothing according to one of the preferred embodiments of the present invention, further illustrating the placement of clothing upon the apparatus.
Figure 2:
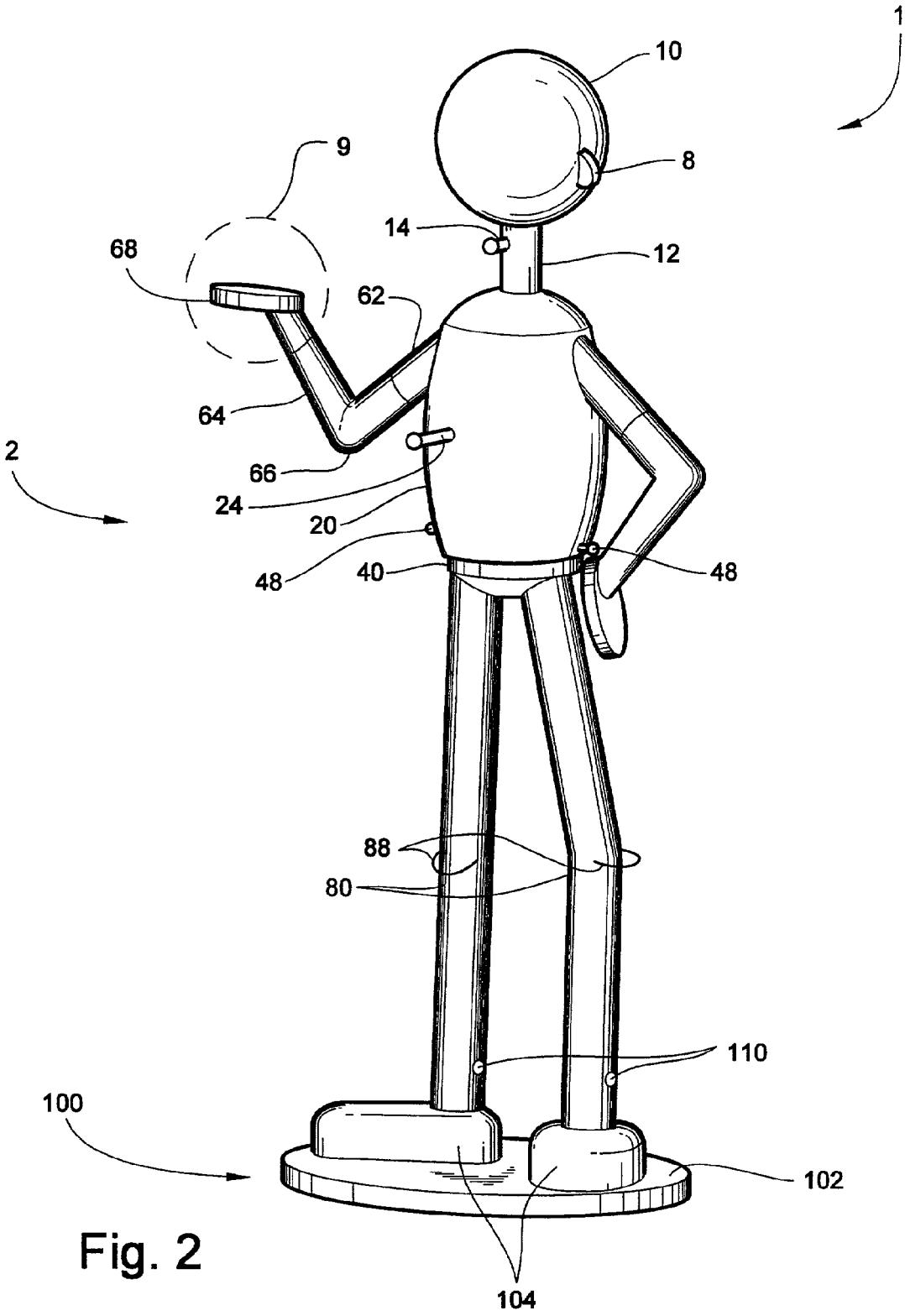
FIG. 2 is a front perspective view of an apparatus of FIG. 1, illustrating the apparatus without clothing.

As illustrated in FIGS. 1–5, the preferred embodiment of an apparatus 1 for organizing and displaying clothing of the present invention is a three-dimensional humanlike form 2, having a head 10, a torso including an upper member 20 and a lower member 40, arms 60, legs 80, a base 100, and at least one projection 24, for example in the middle of the upper torso member 20, from which an article of clothing may be suspended.

Figure 3:
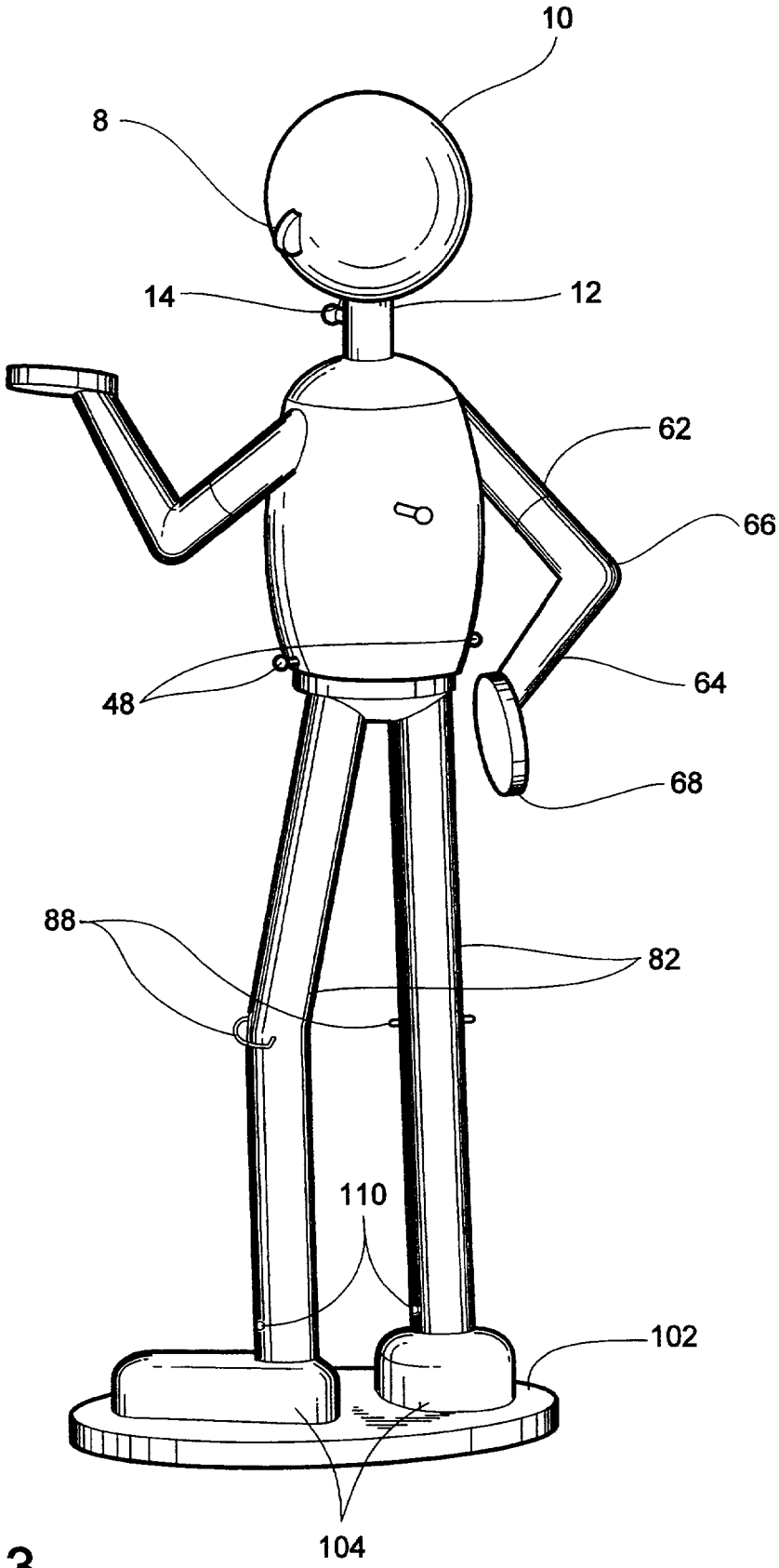
FIG. 3 is a rear perspective view of the apparatus of FIG. 2.
Figure 4:
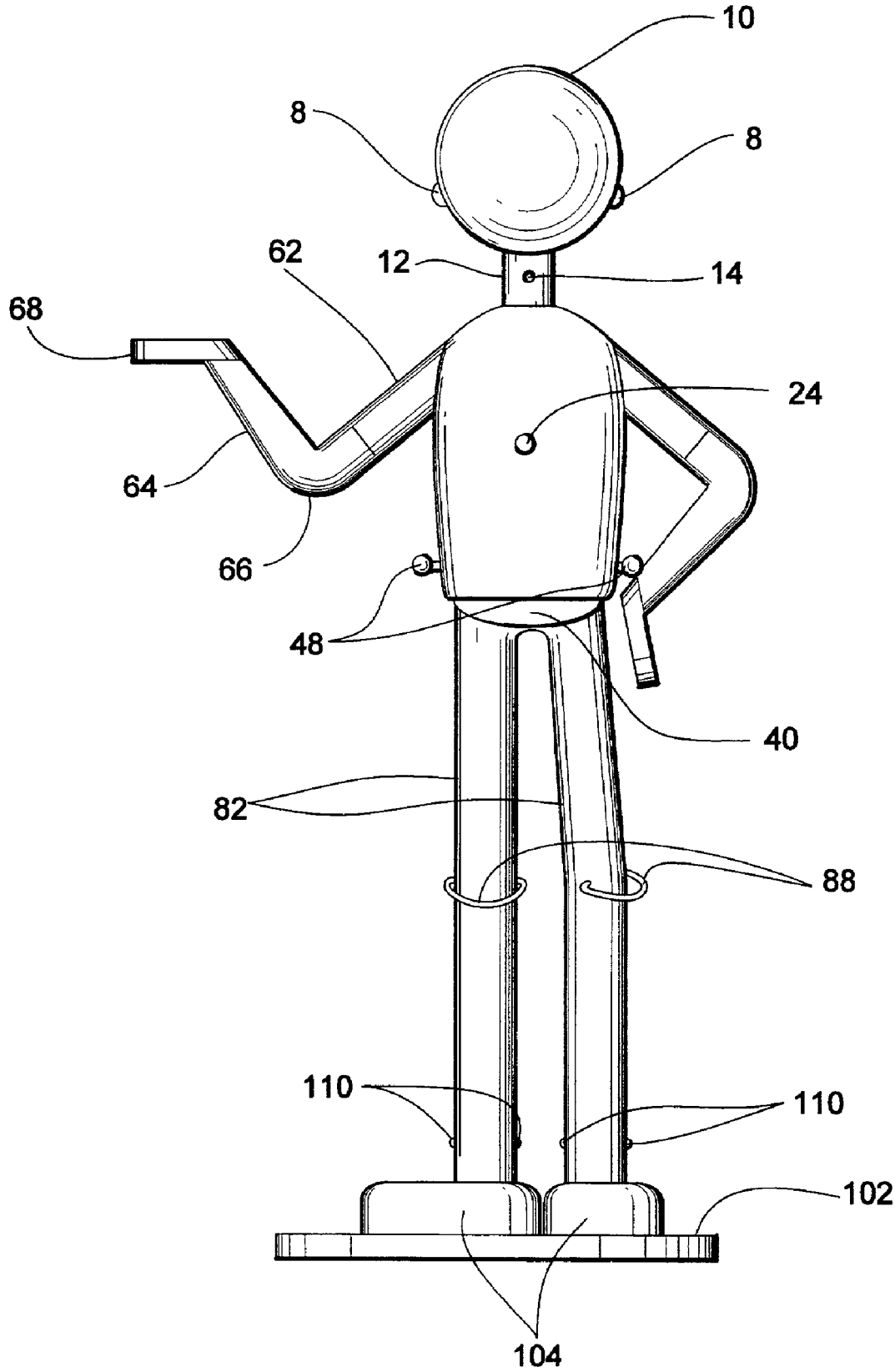
FIG. 4 is a front elevational view of an apparatus of FIG. 2.

The head 10 is generally spherically shaped and is attached to a neck 12. The neck 12 preferably has a projection 14 extending outwardly from the front of the neck 12, the projection 14 configured for suspending clothing, clothes hangers or other suspendable article. The projection 14 has an outer end having an upward extent greater than an inner portion and preferably is a peg with an enlarged outer end. In FIG. 3, it can be seen that the head 10 has two generally ear-shaped portions 8 positioned in generally the same location as ears on a human head. The ears 8 provide a more humanlike configuration to the head 10. In one embodiment, illustrated in FIG. 3, the neck 12 is fixedly attached to the upper member 20 of the torso.

The upper torso member 20 is hollow and generally barrel shaped with a top and a bottom. The bottom of the upper torso member 20 is open. The lower torso member 40 of the torso has a cylindrical portion smaller in diameter than the hollow space within the upper torso member 20 so that the cylindrical portion of the lower torso member 40 can be telescopingly received into the bottom of the upper torso member 20. The upper torso member has two torso adjustment holes 30, located opposite one another on each side of the upper torso member 20 near the bottom and in approximate horizontal alignment with each other. The cylindrical part of the lower torso member 40 has two sets of torso adjustment holes 46, each set having a plurality of holes 46 in vertical alignment. The two sets of adjustment holes 46 are in approximate horizontal alignment with each other to ensure an even adjustment. The adjustment holes 30, 46 have about the same diameter. Two torso adjustment shafts 48 having a diameter slightly smaller than that of the adjustment holes 30, 46 are used to connect the upper torso member 20 to the cylindrical portion of the lower torso member 40. When the adjustment holes 30, 46 are aligned with each other, the torso adjustment shafts 48 can be inserted through the adjustment holes 30 of the upper torso member 20 and the adjustment holes 46 of the cylindrical portion of the lower torso member 40, adjusting the height of the torso by adjusting the amount of the cylindrical portion that is telescopingly received into the bottom of the upper torso member 20. The torso adjustment shafts 48 are preferably of sufficient length to extend outwardly beyond the torso in order to form projections from which may be suspended clothing, clothes hangers or other suspendable articles. In one embodiment (not shown), the torso adjustment shafts 48 have two projections placed diametrically opposed to each other and located toward an end of the shaft to be inserted into the upper torso 20, the projections spaced on each shaft such that the projections engage the upper torso 20 to prevent complete removal of the torso adjustment shafts 48, yet provide sufficient movement away from the form 2 to disengage from the lower torso 40 and allow adjustment of the lower torso 40 relative to the upper torso 20. In a preferred embodiment, the projections of the torso adjustment shafts 48 have outer ends that have an upward extent greater than a portion of the projections inward to the outer ends. Preferably, the projections of the torso adjustment shafts 48 are pegs with enlarged outer ends. A projection 24 extends from about the center of the upper torso member 20 and is configured for suspending clothing, clothes hangers or other suspendable articles. In a preferred embodiment, the projection 24 has an outer end that has an upward extent greater than a portion of the projection inward to the outer end. Preferably, the projection 24 is a peg with an enlarged outer end.

The arms 60 each include an inner arm portion 62, an elbow 66 and an outer arm portion 64. The inner arm portion 62 is generally cylindrical and hollow. The inner arm portion 62 extends from the shoulder area of the upper torso member at a downward inclination of about 45°. The outer arm portion 64 is generally cylindrical and is formed with an elbow 66 bent at about 90° to the outer extent of the outer arm portion 64. The outer arm portion 64 extends inwardly from the elbow 66 in line with the inner arm portion 62 and terminates, preferably, with a slightly smaller diameter than the inner arm portion 62 such that the outer arm portion 64 is telescopingly received into the inner arm portion 62. In one embodiment (not illustrated), the outer arm portion terminates with a shaft having an oversized end that is fit into a cavity formed in the respective inner arm portion, thereby attaching the inner and outer arm portions together. The outer arm portions 64 each has a hand 68 attached at the outer end. The hands 68 may be attached to the outer arm portions 68 by any suitable method such as inserting a part of one into the other, using locking cams, or some other coupling mechanism. The hands 68 each have a palm The palms of the hands 68 either are or preferably concave to allow the holding of coins, jewelry, such as rings and bracelets, hair bows, barrettes, pocket contents and other loose objects. In a preferred embodiment, the outer arm portions 64 can be selectively positioned with the palm facing upward and the elbow used for draping clothing items thereon or rotated so that the hand 68 is disposed vertically downward with its palm facing toward the torso. The illustrated embodiment has one hand 68 selectively positioned with its palm facing up and the other hand facing the torso. In a preferred embodiment, a tray 70 is removably attached to an upraised hand 68, a portion of the bottom of the tray 70 surrounding the side of the hand 68 such that the tray 70 rests upon palm of the hand 68.

Figure 5:
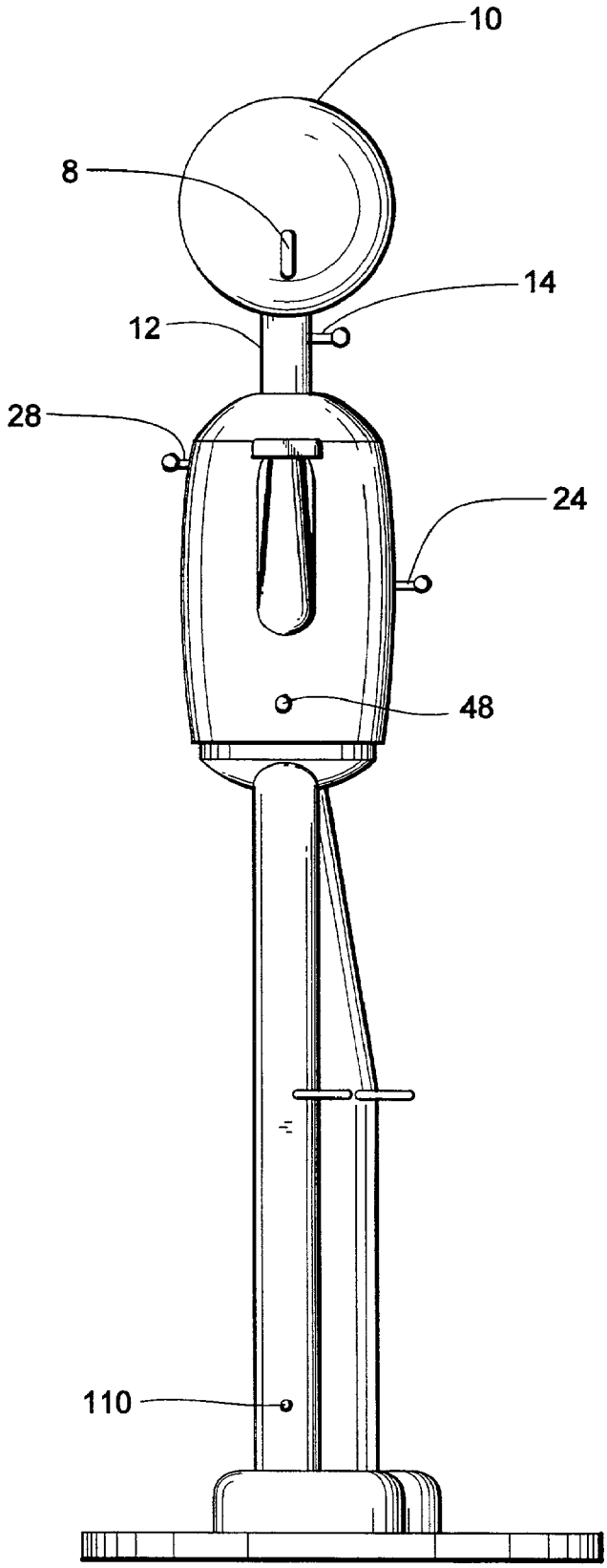
FIG. 5 is a side elevational view of the apparatus of FIG. 2.
Figure 6:
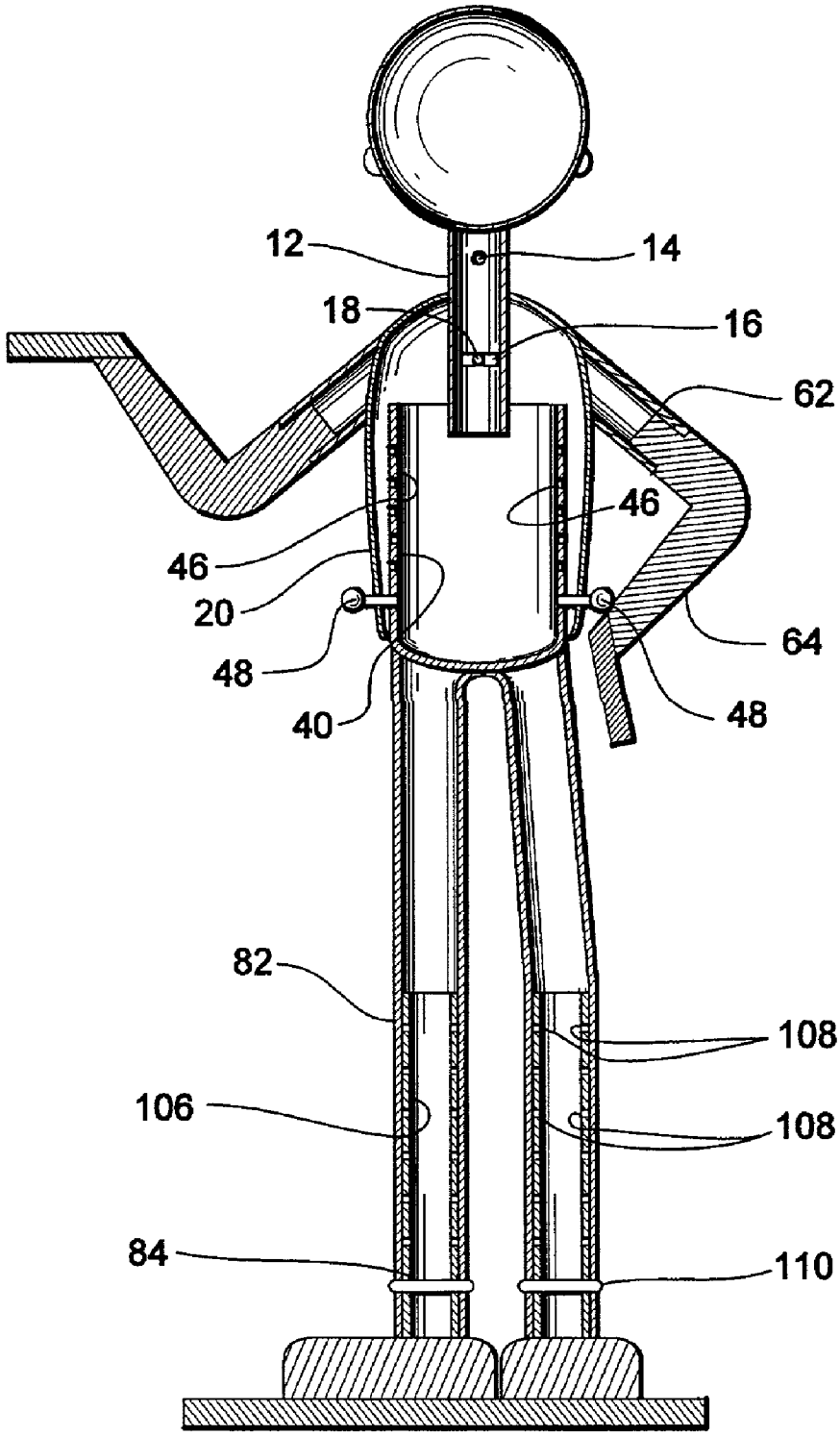
FIG. 6 is a vertical, front facing sectional view of the apparatus of FIG. 5, illustrating the adjustable upper and lower torso members and the adjustable upper and lower leg portions in a first, shorter, adjustable position.
Figure 6A:
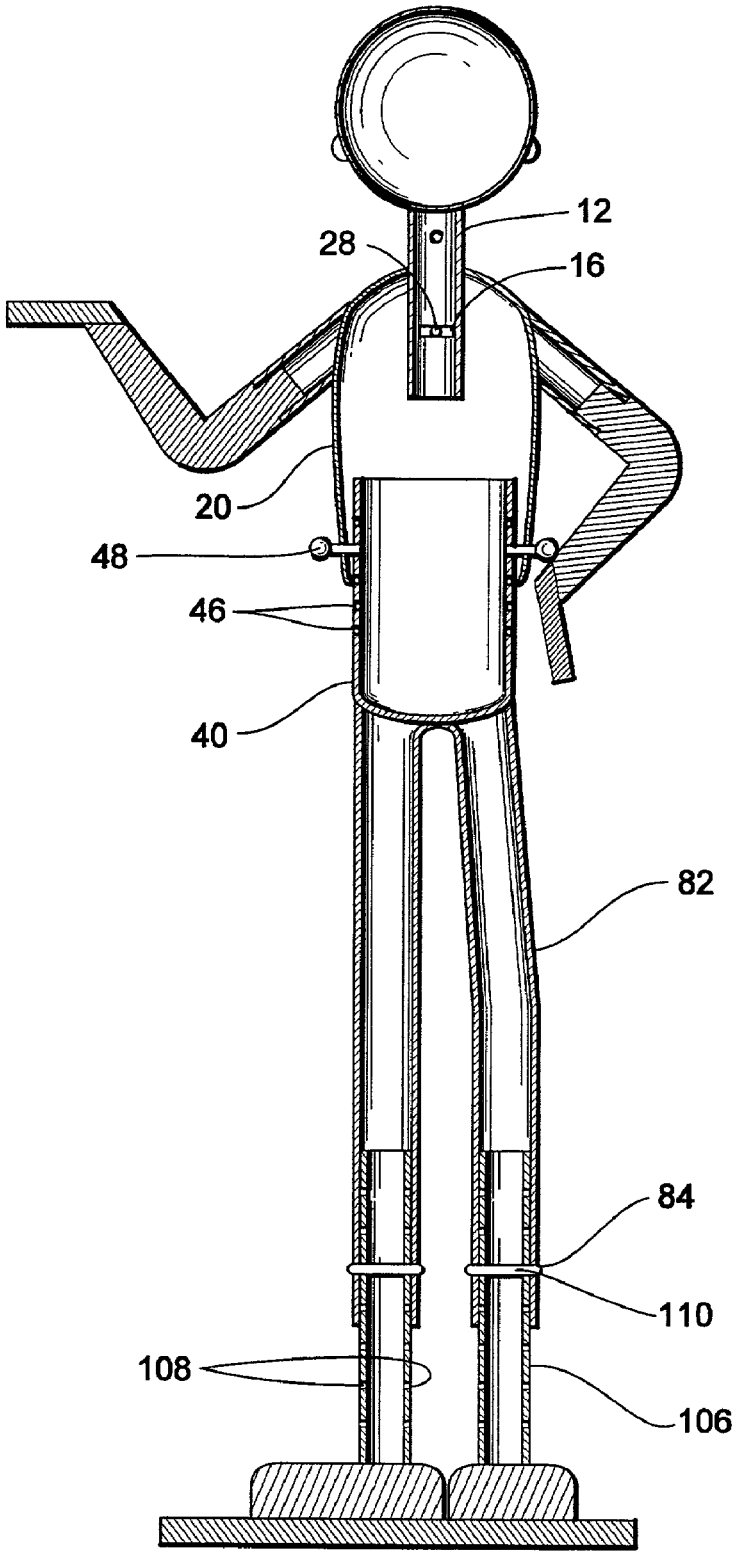
FIG. 6*a* is a view similar to FIG. 6, illustrating the torso members and the leg portions in a tall adjustable position.
Figure 7:
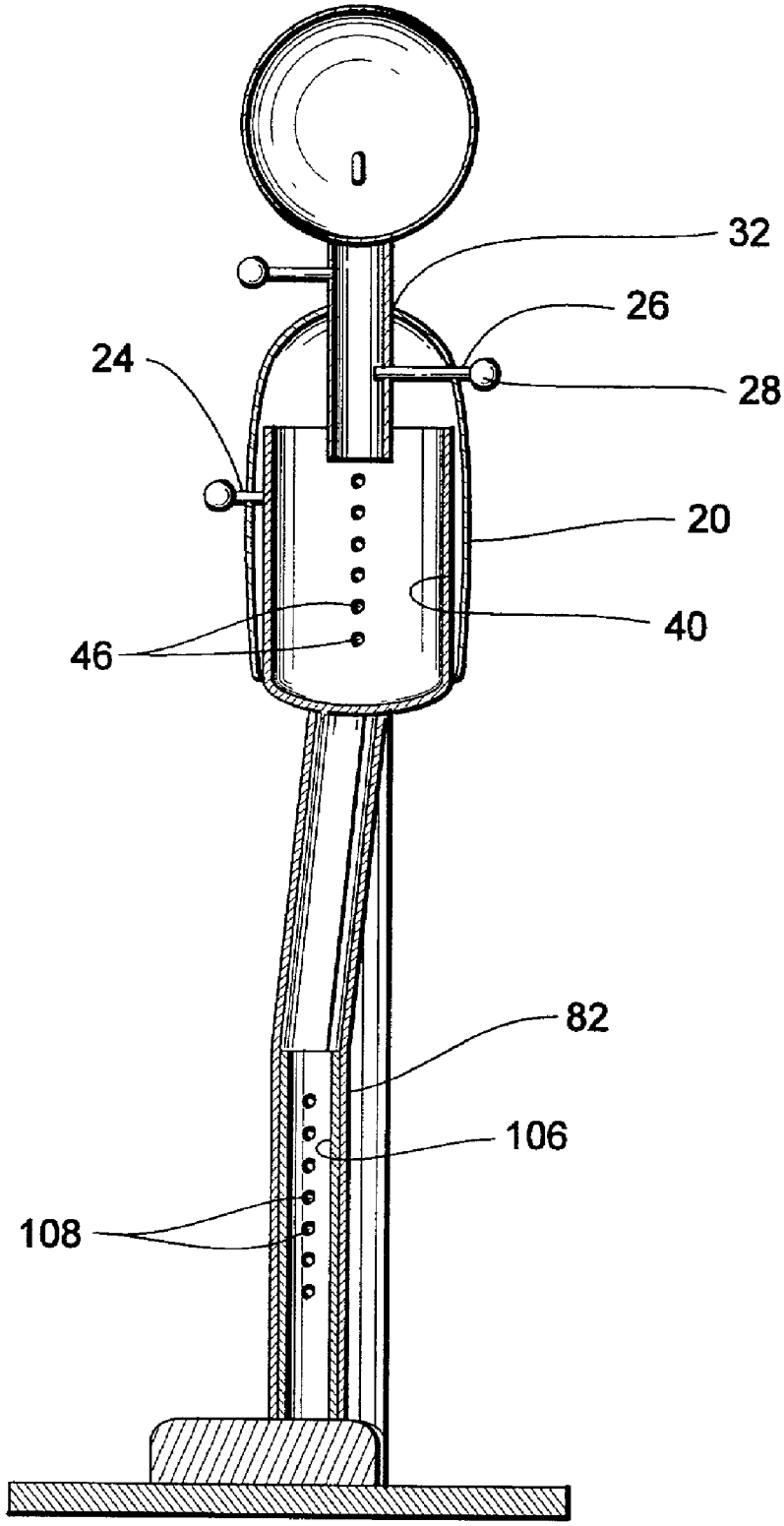
FIG. 7 is a vertical, side facing, sectional view, illustrating the torso members and the leg portions in the short position of FIG. 6.
Figure 8:
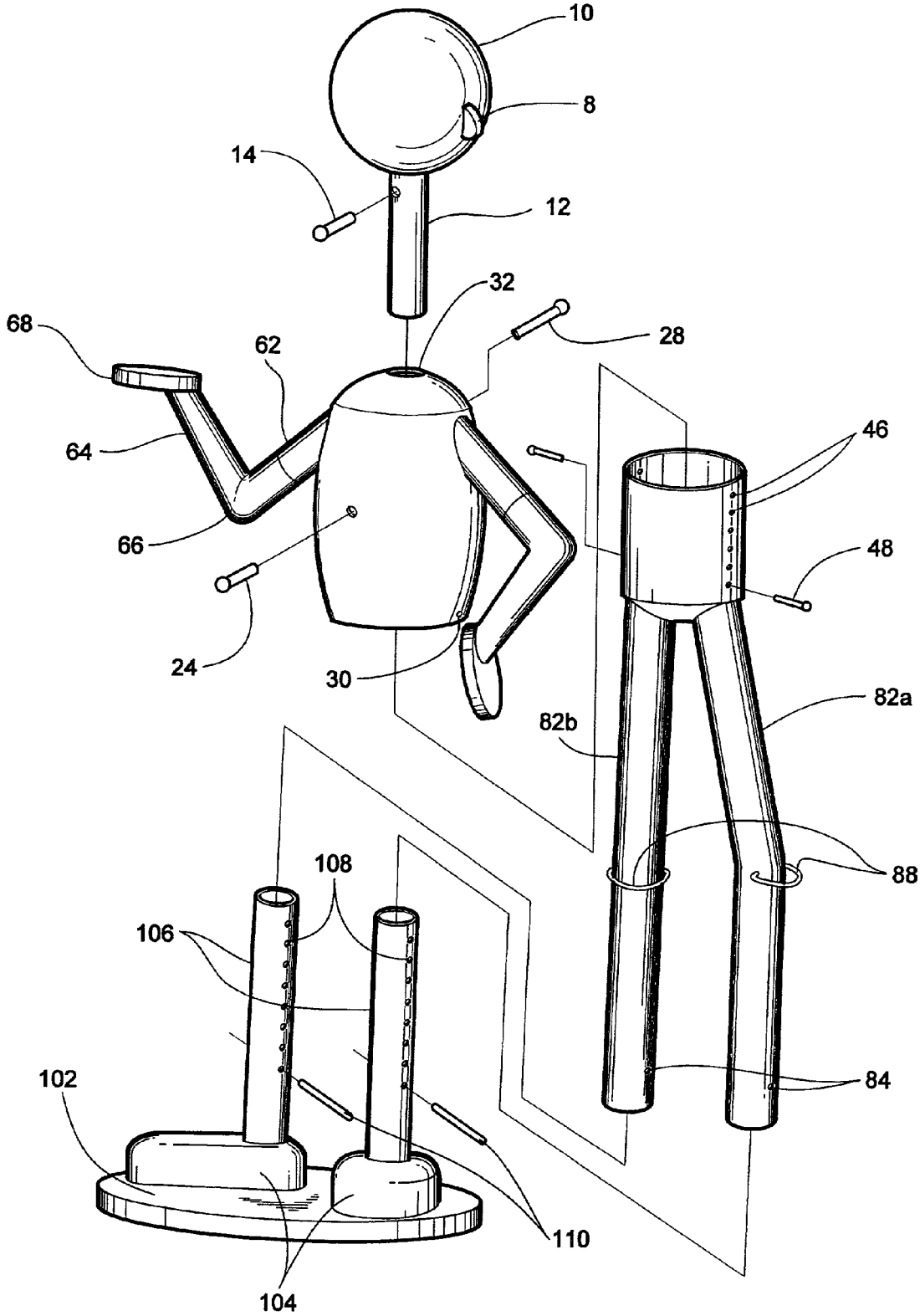
FIG. 8 is an exploded perspective view of the apparatus of FIG. 5.
Figure 9:
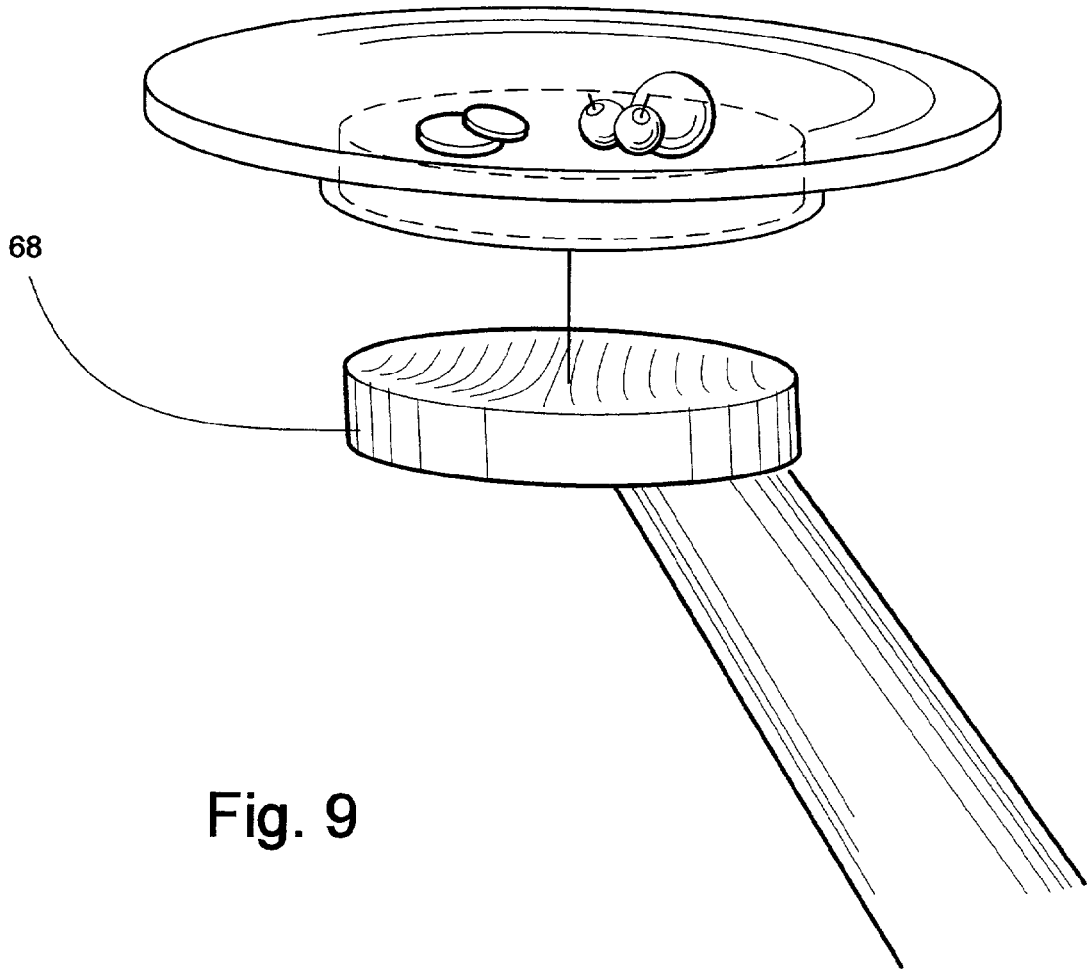
FIG. 9 is a perspective of the hand, illustrating the concave palm and attachable tray.

The legs 80 each include an upper portion 82 and a lower portion 106, both generally cylindrically shaped and hollow. The lower torso member 40 is attached to the upper leg portions 82. In a preferred embodiment, the lower torso member 40 and the upper leg portions 82 are molded as one piece. The lower leg portions 106 have a slightly smaller diameter than the hollow upper leg portions 82 so that the upper ends of the lower leg portions 106 can be telescopingly received by the lower ends of the upper leg portions 82. The upper leg portions 82 each have two adjustment holes 84 located near the lower ends of the upper leg portions 82 and diametrically opposed to each other. Each of the lower leg portions 106 has two sets of diametrically opposed adjustment holes 108, each set having a plurality of holes vertically aligned, as shown in FIGS. 5–7. Leg adjustment pins 110 having a diameter slightly smaller than the adjustment holes 84, 108 and longer than the diameter of the lower end of the upper leg portions 82, are used to connect the upper leg portions 82 and the lower leg portions 106. In one embodiment (not shown), the two adjustment holes 84 of the upper leg portions 82 and of the two sets of adjustment holes 108 of the lower leg portions 106 are replaced by a single, threaded adjustment hole on the upper leg portions 82 and a plurality of vertically aligned threaded adjustment holes on the lower leg portions 106. Threaded set screws or other threaded fasteners are inserted into the upper and lower leg adjustment holes on each leg and tightened, thereby adjustably connecting the upper leg portions 82 to the lower leg portions 106. Each of the upper leg portions 82 has a knee located at about a vertical mid-point of each upper leg portion 82. In the preferred embodiment, projections 88 extend from about each knee from which can be suspended articles of clothing or other suspendable articles. In the illustrated embodiment, the projections 88 are circular loops from which to hang socks.

In the illustrated embodiment, the upper portion of one leg 82*b* is connected to the lower torso member 40 and extends from the lower torso member 40 in a generally vertical direction. The upper portion of the other leg 82*a* is attached to the lower torso member 40 at a slight angle and then slightly bent again at about the knee of the upper portion of the leg 82*a*.

The base 100 of the apparatus 1 is of such size and shape to support the rest of the apparatus 1 in a generally vertical orientation. Two feet 104 are integral to the base and are positioned generally perpendicular to each other. The lower ends of the lower leg portions 106 of the legs 80 are inserted into holes located in the tops of the feet 104 such that the lower portions 106 are rigidly held in place. In one embodiment (not illustrated), the lower ends of the lower leg portions are held within the feet by locking cams. In another embodiment (not illustrated), the lower leg portions may be inserted through the bottom of the base and extend upwardly beyond the tops of the feet.

In one embodiment, as shown in FIGS. 4–7, the neck 12 is rotatably connected to the upper member 20. A neck adjustment slot 16 is formed in the back of the neck 12. The adjustment slot 16 has a horizontal dimension that is greater than a vertical dimension. A neck adjustment hole 26 is formed in the back of the upper member 20. The neck adjustment hole 26 has a diameter the same size as the vertical dimension of the adjustment slot 16. The neck 12 is inserted into the upper member 20 through a hole 32. The adjustment slot 16 is aligned with the neck adjustment hole 26, and a neck adjustment shaft 28 is inserted through the neck adjustment hole 26 and the adjustment slot 16. The neck 12 can then be rotated about a vertical axis along the adjustment slot 16, thereby allowing the neck 12 and head 10 to be rotatably positioned. In one embodiment (not illustrated), multiple neck adjustment slots may be formed in the back of the neck, allowing for vertical adjustment as well as rotational adjustment relative to the upper member. The neck adjustment shaft 28 is preferably of sufficient length to extend outwardly beyond the torso in order to form a projection from which may be suspended clothes hangers or other suspendable articles. In a preferred embodiment, the projection of the neck adjustment shaft 28 has an outer end that has an upward extent greater than a portion of the projections inward to the outer end. Preferably, the projection of the neck adjustment shaft 28 is a peg with an enlarged outer end. In another embodiment (not illustrated), the neck may be attached to the upper torso in such a manner as to retain the rotational adjustment capability without having any neck adjustment slots or holes. In another embodiment, illustrated in FIG. 3, the neck 12 is fixedly attached to the upper torso member 20. A feature of either of the last two embodiments disclosed is that the neck adjustment shaft 28 becomes a second torso projection and is affixed to the upper torso member 20 only, the second torso projection being used to store extra clothes hangers, for example.

The entire form 2 of the apparatus 1 may be made of molded plastic. In the preferred embodiment, the base 100 and the form 2 are both made of molded plastic. The projections 14, 24, the torso adjustment shafts 48, the neck adjustment shaft 28, and the leg adjustment pins 110 can be made of molded plastic, wood, or other sufficiently rigid material. The material of the entire form 2 is capable of having self-adhesive stickers removably attached to it, thereby allowing the child to decorate the entire form 2.

FIG. 1 illustrates one way a child may use the apparatus 1. For example, before bedtime, a child may select the clothing, outer garments, shoes, accessories and jewelry for the next day. The child can place the shirt or blouse on a clothes hanger, if the clothing is not already on a clothes hanger, and suspend the hanger from the projection 14 extending from the neck 12. Likewise, the pants, shorts or skirt may be placed on a clothes hanger and that clothes hanger suspended from the projection 24 extending from the upper torso member 20. Underwear, belts, ties, or other accessories may be suspended from the projections formed as part of the torso adjustment shafts 48. Socks, stockings, or other hosiery may be suspended from the loops 88 extending from the upper leg portions 82. Shoes can be placed on the top 102 of the base 100 and jewelry, hair clips, barrettes, coins and other pocket articles can be stored in the upwardly facing palm of the hand 68 or in the tray 70 removably attached to the hand 68. A sweater, light jacket, or other outer garment may be draped across the crook of the elbow 66 and a hat or head wear may be placed on the head 10. Extra clothes hangers may be suspended from the neck adjustment shaft 28. By assembling the child's entire outfit and displaying it upon the apparatus 1 the night before, the child will have their clothing selected and in one place for easy access and dressing upon arising the following morning. Additionally, because the clothing is selected prior to the rush of getting dressed and traveling to school or other activity, the selected outfit can be reviewed and cleaned, pressed or mended as necessary. Finally, utilizing the apparatus 1 provides the child an opportunity to learn, either alone or with parental guidance, how to select clothing for different activities and to develop proper dressing habits. It should be understood that the use of clothes hangers, as illustrated in FIG. 1, is not necessary and that clothing can be suspended directly from the projections 14, 24 without the use of clothes hangers.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for organizing and displaying clothing, comprising a humanlike form with at least one peg projecting from said form for suspending articles of clothing therefrom, said form having a head, a neck, a torso having an upper member and a lower member, two arms, two legs, two feet and a base, (a) the head affixed to the neck, (b) the neck having a front and a back, a neck peg extending from the front of the neck and configured for hanging a clothes hanger therefrom, (c) the upper member of the torso having a front, a back, and two sides, a first torso peg and a second torso peg extending from the front and the back of the upper member, respectively, the first and second torso pegs configured for hanging a clothes hanger therefrom, the head and neck connected to the upper member such that the rotational position of the head and neck relative to the upper member can be adjusted, first and second torso adjustment holes penetrating the upper member of the torso, one on each side of the upper member, (d) each arm has an inner portion and an outer portion to which a hand is attached at a first end, the outer portion pivotally connected to the inner portion at a second end for selective positioning of the outer portion and hand wherein one selected hand position is with a palm of the hand facing upwardly for holding articles thereon, the outer portion angled at an elbow located between the hand and the inner portion, (e) the lower member of the torso having an upper cylindrical portion telescopingly received in an open bottom of the upper member, a plurality of adjustment holes formed along each side of the cylindrical portion in spaced vertical alignment, first and second torso adjustment shafts slightly smaller than the torso adjustment holes in the upper portion and the cylindrical portion, the upper and lower members adjustably connected by aligning the adjustment holes in the upper member with one of the said plurality of adjustment holes on each side of the cylindrical portion and penetrating the torso adjustment holes in the upper member and the cylindrical portion with the first and second torso adjustment shafts, (f) the legs each having an upper portion and a lower portion, the upper portions each having an upper end, a lower end, a knee and two sides, the upper end of the upper portions extending from the lower member of the torso, the upper portions each having first and second leg adjustment holes positioned opposite each other on each side of the upper portion, the lower portions each having an upper end, a lower, end and two sides, the lower portions each having a plurality of leg adjustment holes formed along each side of the lower portions in spaced vertical alignment, first and second leg adjustment pins slightly smaller than the leg adjustment holes, each leg adjustment pin being of sufficient length such that when the upper and lower leg adjustment holes are aligned with each other, the first and second leg adjustment pins can be inserted in one side of each portion and protrude through the other side of each leg adjustably connecting the upper and lower portions, the upper portions each having a peg affixed near the knees, (g) the feet each having a top and a bottom, the top of each foot having a leg hole of a size sufficient for the lower ends of the lower portions of the legs to be inserted into the leg holes, the bottom of each foot being affixed to the base, and (h) the base being of such size and shape as to support the completed apparatus in a vertical, upright position.

2. The apparatus according to claim 1 wherein said form is made of molded plastic.

3. The apparatus according to claim 1 wherein first arid second ear-shaped portions are disposed on the head at locations generally corresponding to the locations of ears on a human head.

4. The apparatus according to claim 1 wherein the neck peg and the first and second torso pegs each has an outer end having an upward extent greater than a portion of the projection inward of said outer end.

5. The apparatus according to claim 1 wherein the neck peg and the first and second torso pegs have enlarged outer ends.

6. The apparatus according to claim 1 wherein the palms are generally concave.

7. The apparatus according to claim 1, characterized further in that a tray is removably attached to the hand, the tray having a bottom surface molded to surround the hand so that the tray rests securely upon the palm of the hand.

8. The apparatus according to claim 1 wherein the torso adjustment shafts are of sufficient length to protrude from the sides of the torso to form pegs configured for hanging articles of clothing therefrom.

9. The apparatus according to claim 8 wherein the pegs of the torso adjustment shafts have an outer end having an upward extent greater than a portion of the pegs inward of said outer end.

10. The apparatus according to claim 8 wherein the pegs of the torso adjustment shafts have enlarged ends.

11. The apparatus according to claim 1, further comprising a neck adjustment slot formed in the back of the neck, the neck adjustment slot having a horizontal dimension greater than a vertical dimension, a neck adjustment hole formed in the back of the upper member having a vertical dimension the same as the neck adjustment slot, a neck adjustment shaft slightly smaller than the vertical dimensions of the neck adjustment slot and the neck adjustment hole, the neck and upper member adjustably connected by the neck adjustment shaft penetrating the neck adjustment hole and the neck adjustment slot.

12. The apparatus according to claim 11, wherein the neck adjustment shaft is the second torso peg.

13. The apparatus according to claim 11 wherein the neck adjustment shaft is of sufficient length to protrude from the torso to form a peg configured for suspending clothes hangers or articles of clothing therefrom.

14. The apparatus according to claim 13 wherein the peg of the neck adjustment shaft has an outer end having an upward extent greater than a portion of the peg inward of said outer end.

15. The apparatus according to claim 13 wherein the peg of the neck adjustment shaft has an enlarged end.

16. The apparatus of claim 1 wherein the peg on the upper portion of at least one of said legs is a circular loop for hanging socks thereon.

17. The apparatus according to claim 1 wherein the upper portion of one said leg extends from the lower member of the torso in an approximately vertical direction and the upper portion of the other said leg extends from the lower member of the torso at an angle.

18. An apparatus for organizing and displaying clothing, comprising a humanlike form with at least one peg projecting from said form for suspending articles of clothing therefrom, said form having a head, a neck, a torso having an upper member and a lower member, two arms, two legs, two feet and a base, the neck having a front and a back, a neck adjustment slot formed in the back of the neck, the neck adjustment slot having a horizontal dimension greater than a vertical dimension, the upper member of the torso having a front, a back, and two sides, a neck adjustment hole formed in the back of the upper member, the neck adjustment hole having a vertical dimension the same as the neck adjustment slot, a neck adjustment shaft slightly smaller than the vertical dimensions of neck adjustment slot and the neck adjustment hole, the neck and upper member adjustably connected by the neck adjustment shaft penetrating the neck adjustment hole and the neck adjustment slot such that the rotational position of the head and neck relative to the upper member can be adjusted.

19. The apparatus according to claim 18 wherein the neck adjustment shaft is of sufficient length to protrude from the torso to form a peg configured for suspending clothes hangers or articles of clothing therefrom.

20. The apparatus according to claim 19 wherein the peg of the neck adjustment shaft has an outer end having an upward extent greater than a portion of the projection inward of said outer end.

21. The apparatus according to claim 19 wherein the peg of the neck adjustment shaft has an enlarged end.

22. An apparatus for organizing and displaying clothing, comprising a humanlike form with at least one peg projecting from said form for suspending articles of clothing therefrom, said form having a head, a neck, a torso having an upper member and a lower member, two arms, two legs, two feet and a base, the upper member having a front, a back, and two sides, first and second torso adjustment holes penetrating the upper member of the torso, one on each side of the upper member, the lower member of the torso having an upper cylindrical portion telescopingly received in an open bottom of the upper member, a plurality of adjustment holes formed along each side of the cylindrical portion in spaced vertical alignment, first and second torso adjustment shafts slightly smaller than the torso adjustment holes in the upper portion and the cylindrical portion, the upper and lower members adjustably connected by aligning the adjustment holes in the upper member with one of the said plurality of adjustment holes on each side of the cylindrical portion and penetrating the torso adjustment holes in the upper member and the cylindrical portion with the first and second torso adjustment shafts.

23. The apparatus according to claim 22 wherein the torso adjustment shafts are of sufficient length to protrude from the sides of the torso to form pegs configured for hanging articles of clothing therefrom.

24. The apparatus according to claim 23 wherein the pegs of the torso adjustment shafts have an outer end having an upward extent greater than a portion of the pegs inward of said outer end.

25. The apparatus according to claim 23 wherein the pegs of the torso adjustment shafts have enlarged ends.

26. An apparatus for organizing and displaying clothing, comprising a humanlike form with at least one peg projecting from said form for suspending articles of clothing therefrom, said form having a head, a neck, a torso having an upper member and a lower member, two arms, two legs, two feet and a base, the legs each having an upper portion and a lower portion, the upper portions each having an upper end, a lower end, a knee and two sides, the upper end of the upper portions extending from the lower member of the torso, the upper portions each having first and second leg adjustment holes positioned opposite each other on each side of the upper portion, the upper portion telescopingly receiving the lower portions, each lower portion having an upper end, a lower end and two sides, the lower portions each having a plurality of leg adjustment holes formed along each side of the lower portions in spaced vertical alignment and aligned with the leg adjustment holes of the upper portion, first and second leg adjustment pins slightly smaller than the leg adjustment holes, each leg adjustment pin being of sufficient length such that when the upper and lower leg adjustment holes are aligned with each other, the first and second leg adjustment pins can be inserted in one side of each portion and protrude through the other side of each leg adjustably connecting the upper and lower portions.

27. The apparatus according to claim 26, wherein the upper portion of at least one of the legs has a peg affixed near the knee.

28. The apparatus according to claim 27, wherein a circular loop is attached to said upper portion of said at least one of said legs for hanging socks thereon.

29. The apparatus according to claim 26 wherein the upper portion of one said leg extends from the lower member in an approximately vertical direction and the upper portion of the other said leg extends from the lower member at an angle.

* * * * *